US006769960B2

(12) United States Patent
Sakai

(10) Patent No.: US 6,769,960 B2
(45) Date of Patent: Aug. 3, 2004

(54) SYSTEM FOR MANUFACTURING A SEMICONDUCTOR DEVICE, POLISHING SLURRY FEEDER AND METHOD FOR MANUFACTURING A SEMICONDUCTOR DEVICE

(75) Inventor: Katsuhisa Sakai, Tokyo (JP)

(73) Assignee: Renesas Technology Corp., Tokyo (JP)

( * ) Notice: Subject to any disclaimer, the term of this patent is extended or adjusted under 35 U.S.C. 154(b) by 0 days.

(21) Appl. No.: 10/309,119

(22) Filed: Dec. 4, 2002

(65) Prior Publication Data

US 2003/0228830 A1 Dec. 11, 2003

(30) Foreign Application Priority Data

May 31, 2002 (JP) ..... 2002-159641

(51) Int. Cl.[7] ..... B24B 1/00
(52) U.S. Cl. ..... 451/8; 451/36; 451/60
(58) Field of Search ..... 451/5, 8, 36, 41, 451/53, 60

(56) References Cited

U.S. PATENT DOCUMENTS 5,637,185 A * 6/1997 Murarka et al. ..... 438/5
5,846,398 A * 12/1998 Carpio ..... 205/775
6,048,256 A * 4/2000 Obeng et al. ..... 451/60
6,214,732 B1 * 4/2001 Easter et al. ..... 438/690
6,258,231 B1 * 7/2001 Easter et al. ..... 204/421
6,488,570 B1 * 12/2002 James et al. ..... 451/36
6,603,320 B2 * 8/2003 Higo ..... 324/702
2003/0100247 A1 * 5/2003 Kim et al. ..... 451/60

FOREIGN PATENT DOCUMENTS

| | | |
|---|---|---|
| JP | 10-315135 | 12/1998 |
| JP | 2000-117635 | 4/2000 |
| JP | 2000-158343 | 6/2000 |
| JP | 2000-280170 | 10/2000 |
| JP | 2000-308956 | 11/2000 |
| JP | 2001-79759 | 3/2001 |

* cited by examiner

*Primary Examiner*—Joseph J. Hail, III
*Assistant Examiner*—David B. Thomas
(74) *Attorney, Agent, or Firm*—Burns, Doane, Swecker & Mathis, L.L.P.

(57) ABSTRACT

An apparatus for manufacturing a semiconductor device by polishing the surface of a semiconductor substrate is provided, which comprises a polishing pad for polishing the substrate surface, a polishing slurry feed apparatus for feeding a polishing slurry to the substrate surface, and a measuring instrument including an electrode (A) and an electrode (B) immersed in a polishing slurry, wherein a characteristic variation of the polishing slurry is detected from a variation in value of an electric current passing between the electrode (A) and the electrode (B) or from a variation in potential difference between the electrodes.

12 Claims, 8 Drawing Sheets

SYSTEM FOR MANUFACTURING A SEMICONDUCTOR DEVICE, POLISHING SLURRY FEEDER AND METHOD FOR MANUFACTURING A SEMICONDUCTOR DEVICE

BACKGROUND OF THE INVENTION

1. Field of the Invention

The present invention relates to a system for manufacturing a semiconductor device, a polishing slurry feeder and a method for manufacturing a semiconductor device, and is more particularly suited for application to a system for manufacturing a semiconductor device wherein chemical mechanical polishing is carrier out, a polishing slurry feeder of chemical mechanical polishing and a method for manufacturing a semiconductor device by using chemical mechanical polishing.

2. Background Art

In recent years, a chemical mechanical polishing (CMP) technique has been in frequent use in semiconductor-manufacturing processes. In the procedure of this CMP method, a polishing slurry called merely slurry is used. Polishing characteristics are significantly varied depending on the type of polishing slurry. For the purpose of mainly monitoring a variation in polishing rate, a $H_2O_2$ densitometer is set in currently employed polishing slurry feeders to measure the concentration thereof.

However, the polishing slurry has factors of varying various polishing characteristics other than the polishing rate. In the conventional method, monitoring with a $H_2O_2$ densitometer has been made only with respect to the variation of the polishing rate, and it has been difficult to detect other polishing characteristics, e.g. polishing characteristics relating, for example, to the occurrence of scratches, dishing, erosion and defects. Under these circumstances, a difficulty has been involved in permitting good polishing characteristics to be continuedly kept because of the variation of these polishing characteristics, with the attendant problem that electric characteristics and the like of a wiring film degrade.

SUMMARY OF THE INVENTION

The invention has been made in order to solve the above problem and has for its object the detection of variations in a polishing slurry of polishing characteristics relating to scratches, dishing, erosion, defects and the like, thereby permitting good polishing characteristics to be kept continuedly.

According to one aspect of the present invention, a system for manufacturing a semiconductor device by polishing a substrate surface comprises a polishing pad, a polishing slurry feeding apparatus and a measuring apparatus. The polishing pad is for polishing the substrate surface. The polishing slurry feeding apparatus is for feeding a polishing slurry to the substrate surface. The measuring apparatus is immersed in the polishing slurry and including at least two electrodes. The measuring apparatus is arranged so that a characteristic variation of the polishing slurry is detected from a value of a current passing between the electrodes or a variation in potential difference between the electrodes.

According to another aspect of the present invention, a polishing slurry feeder for feeding a polishing slurry to a substrate polishing device comprises a measuring apparatus. The measuring apparatus is immersed in the polishing slurry and including at least two electrodes. The measuring apparatus is arranged so that a characteristic variation of the polishing slurry is detected from a value of a current passing between the electrodes or a variation in potential difference between the electrodes.

According to another aspect of the present invention, a method for manufacturing a semiconductor device using a semiconductor manufacturing system is provided. The system comprises a polishing pad, a polishing slurry feeding apparatus and a measuring apparatus. The polishing pad is for polishing the substrate surface. The polishing slurry feeding apparatus is for feeding a polishing slurry to the substrate surface. The measuring apparatus is immersed in the polishing slurry and including at least two electrodes. The measuring apparatus is arranged so that a characteristic variation of the polishing slurry is detected from a value of a current passing between the electrodes or a variation in potential difference between the electrodes.

According to the present invention, when a variation in value of a current passing between the electrodes immersed in a polishing slurry or a variation in difference of a potential between the electrodes is detected, the variation in chemical reaction quantity of the electrodes and the polishing slurry can be detected, enabling the characteristics of the polishing slurry to be detected.

According to the present invention, since the variation in characteristics of the polishing slurry can be suppressed, scratches, dishing, erosion, defects and the like are suppressed from occurring, ensuring the manufacture of a semiconductor device of high reliability.

Other and further objects, features and advantages of the invention will appear more fully from the following description.

DETAILED DESCRIPTION OF THE PREFERRED EMBODIMENTS

Several embodiments of the invention are described in detail with reference to the accompanying drawings. It will be noted that the invention should not be construed as limiting to these embodiments.

First Embodiment

Figure 1:
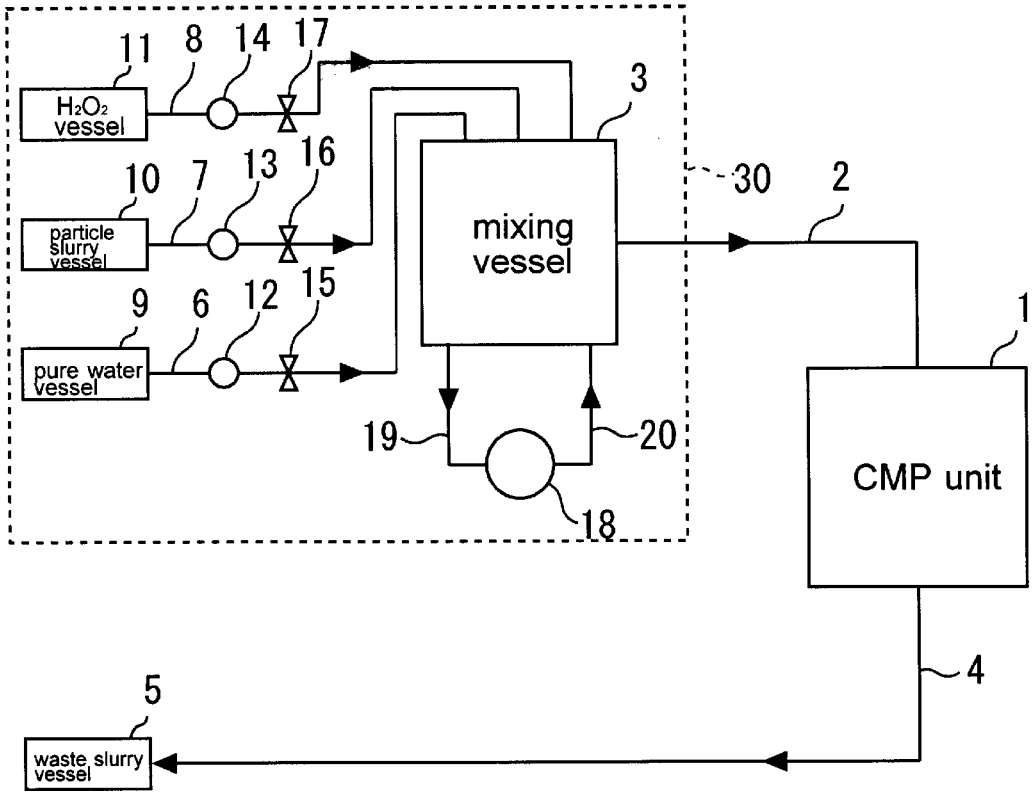
FIG. 1 is a schematic view showing a polishing slurry feeding system according to a first embodiment.

FIG. 1 is a schematic view showing a polishing slurry feeding system according to a first embodiment. As shown in FIG. 1, a CMP unit 1 is connected with a mixing vessel 3 through a feed pipe 2 and also with a waste slurry vessel 5 through a waste slurry pipe 4. The CMP unit 1 is provided with a polishing pad for polishing the surface of a semiconductor substrate, and a film to be polished, which is formed on the semiconductor substrate, is polished by the polishing pad. The mixing vessel 3 is connected with a pure water vessel 9, a particle slurry vessel 10 and a $H_2O_2$ vessel 11 through feed pipes 6, 7, 8, respectively. The stock fluids of the polishing slurry are, respectively, passed from the pure water vessel 9, the particle slurry vessel 10 and the $H_2O_2$ vessel 11 by the force of the pressure of a pump, and are, respectively, passed through the feed pipes 6, 7, 8 and fed to the mixing vessel 3 through valves 12, 13, 14 and flow meters 15, 16, 17. The stock fluids are agitated in the mixing vessel 3, and the resulting polishing slurry (slurry) is fed to the CMP unit 1 under the pressure of a pump. The CMP treatment is carried out by use of the polishing slurry in the CMP unit 1. A waste slurry after the CMP treatment is discharged through a waste slurry pipe 4 to a waste slurry vessel 5 and is thus collected and disposed.

As shown in FIG. 1, the polishing slurry feeder 30 is constituted of the pure water vessel 9, the particle slurry vessel 10, the $H_2O_2$ vessel 11 and the mixing vessel 3. In this way, the polishing slurry feeding system as shown in FIG. 1 may be arranged by connection of the polishing slurry feeder 30 and the CMP unit 1, or the whole system arrangement of FIG. 1 may be provided as a single semiconductor manufacturing apparatus.

Figure 2:
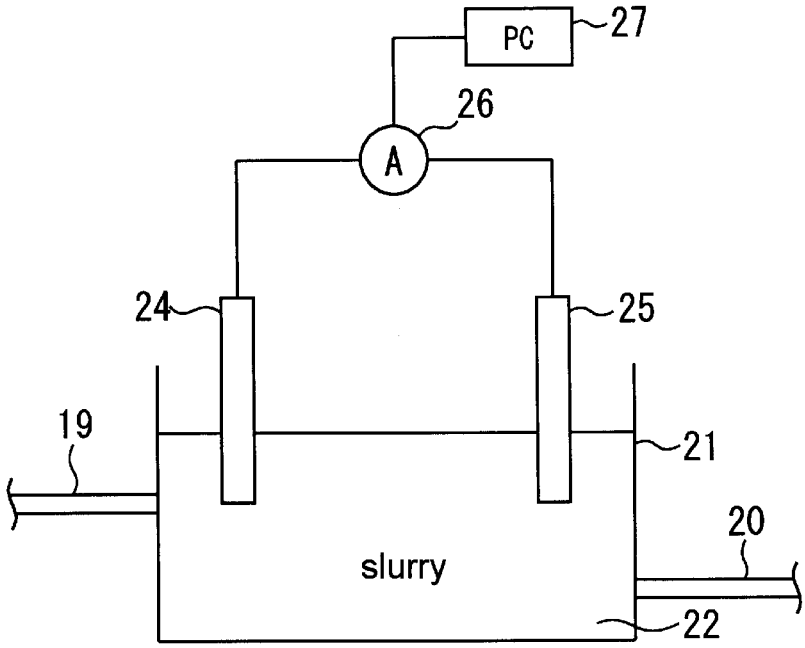
FIG. 2 is a schematic view showing an arrangement of the measuring instrument.

The mixing vessel 3 is connected with a measuring instrument 18 for inspecting characteristics of a polishing slurry. FIG. 2 is a schematic view showing an arrangement of the measuring instrument 18. The measuring instrument 18 is connected to the mixing vessel 3 through pipes 19, 20 and includes an electrode (A) 24 and an electrode (B) 25, both immersed in a polishing slurry 22 in a polishing slurry vessel 21, an ampere meter 26 for measuring an electric current passing between the electrode (A) 24 and the electrode (B) 25, and a personal computer 27 for monitoring a measurement of the ampere meter 26. The polishing slurry 22 in the mixing vessel 3 is passed from the pipe 19 to the polishing slurry vessel 21 and inspected, followed by returning to the mixing vessel 3 through the pipe 20.

Figure 3A:
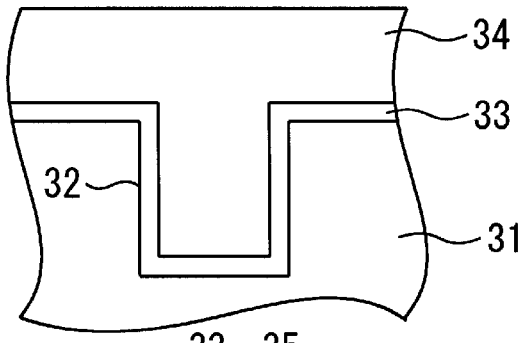
FIGS. 3A and 3B are schematic sectional views showing a typical structure of a semiconductor device for which the CMP treatment is carried out in the CMP unit.
Figure 3B:
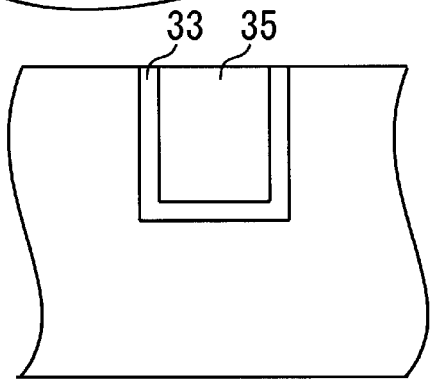

FIGS. 3A, 3B and FIGS. 4A, 4B are each a schematic sectional view showing a typical structure of a semiconductor device for which the CMP treatment is carried out in the CMP unit 1. Of these, FIGS. 3A and 3B show a method of forming a wiring according to the so-called single Damascene process. In this method, as shown in FIG. 3A, a groove (trench) for wiring 32 is formed in an insulating film 31 by a method such as dry etching, and a barrier metal 33 containing at least one of Ta, a Ta compound, Ti or a Ti compound is formed in the wiring groove 32 as a film, followed by forming a copper (Cu) film 34 over the entire surface such as by plating. Next, as shown in FIG. 3B, the semiconductor device having the structure of FIG. 3A is subjected to the CMP treatment in the CMP unit 1. In doing so, the copper film 34 is polished, thereby forming a wiring 35 consisting of the copper film 34 that is buried in the wiring groove 32.

Figure 4A:
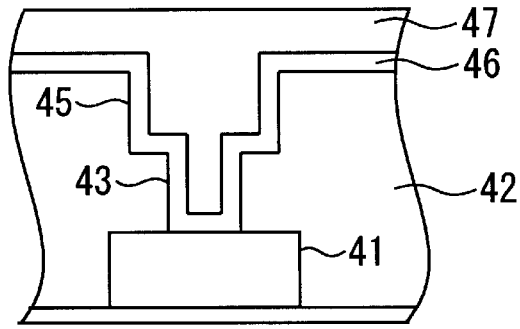
FIGS. 4A and 4B are schematic sectional views showing a typical structure of a semiconductor device for which the CMP treatment is carried out in the CMP unit.
Figure 4B:
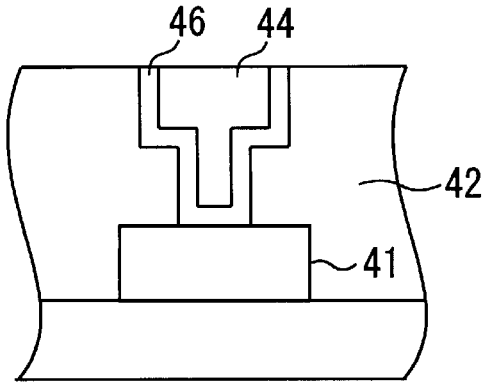

FIGS. 4A and 4B show a method of forming a wiring according to the so-called dual Damascene process. This method ensures not only the formation of wirings, but also the formation of a contact plug mutually connecting wirings existing in different layers. First, as shown in FIG. 4A, a lower wiring 41 is formed, after which an insulating film 42 is formed and a hole 43 arriving at the lower wiring 41 is bored by a method such as dry etching. Thereafter, a wiring groove 45, in which an upper wiring 44 is to be buried, is formed by a method such as dry etching. Then, a barrier metal 46 containing at least one of Ta, a Ta compound, Ti and a Ti compound is formed, as a film, on the inner walls of the hole 43 and the wiring groove 45, followed by forming a copper (Cu) film 47 such as by plating.

Next, as shown in FIG. 4B, the semiconductor device provided with such a structure of FIG. 4A is subjected to the CMP treatment in the CMP unit 1. As a result, the copper film 47 is polished, thereby forming the upper wiring 44. made of the copper film 47 that has been buried in the wiring groove 45.

Figure 10A:
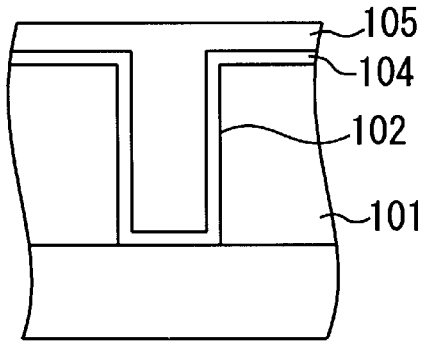
FIGS. 10A and 10B show a method of forming the so-called tungsten plug.
Figure 10B:
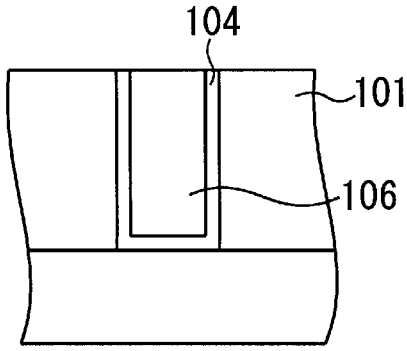

FIGS. 10A and 10B show a method of forming the so-called tungsten plug. In this method, a hole 102 is bored in an insulating film 101 by a method such as dry etching as shown in FIG. 10A. Thereafter, a barrier metal 104 containing at least one of Ta, a Ta compound, Ti and a Ti compound is formed as a film in the hole 102, followed by forming a tungsten film 105 over the entire surface by a CVD method or the like.

As shown in FIG. 10B, the semiconductor device provided with the structure of FIG. 10A is subjected to the CMP treatment in the CMP unit 1. By the treatment, the tungsten film 105 is polished to form a plug 106 made of the tungsten film 105 that has been buried in the hole 102.

Figure 11A:
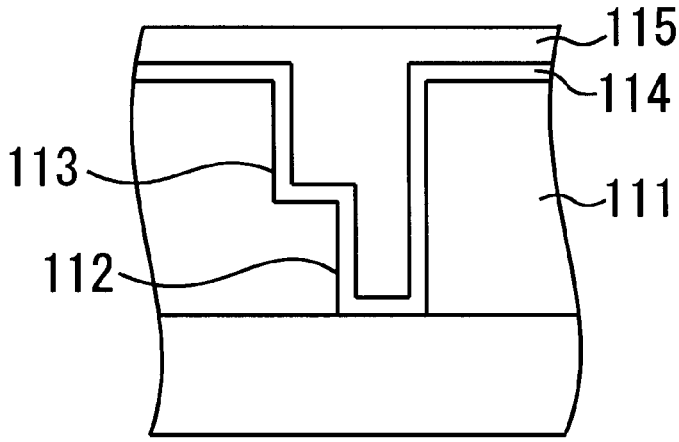
FIGS. 11A and 11B show a method of forming the so-called tungsten-buried wiring.
Figure 11B:
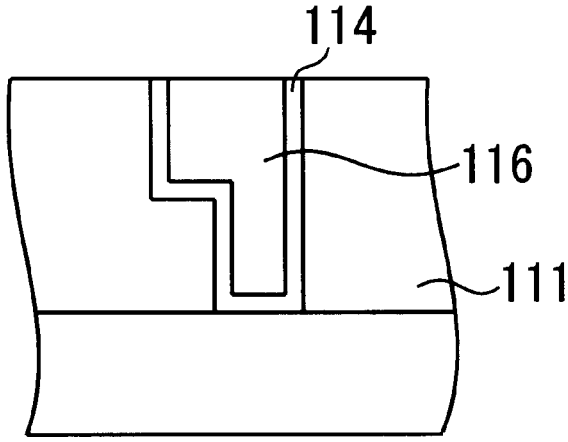

FIGS. 11A and 11B show a method of forming the so-called tungsten-buried wiring. According to this method, as shown in FIG. 11A, a hole 112 and a wiring groove 113 are bored in an insulating film 111 by a method such as dry etching. Thereafter, a barrier metal 114 containing at least one of Ta, a Ta compound, Ti and a Ti compound is formed as a film in the hole 112 and the wiring groove 113, followed by forming a tungsten film 115 over the entire surface by a CVD method or the like.

Next, as shown in FIG. 11B, the semiconductor device having the structure of FIG. 11A is subjected to a CMP treatment in the CMP unit 1. By the treatment, the tungsten film 115 is polished to form a buried wiring 116 made of the tungsten film 115 that has been buried in the hole 112 and the wiring groove 113.

Figure 12A:
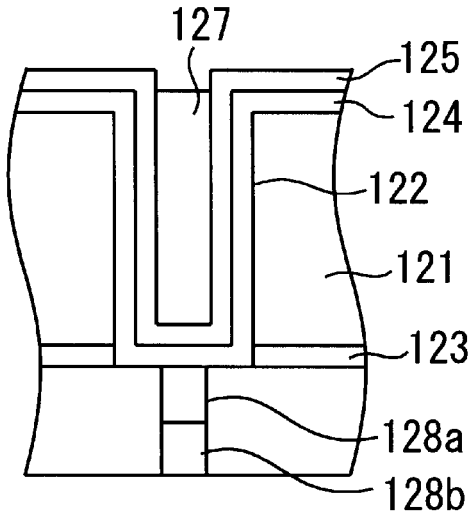
FIGS. 12A through 12C show a method of forming the so-called capacitance for storing electric charges.
Figure 12B:
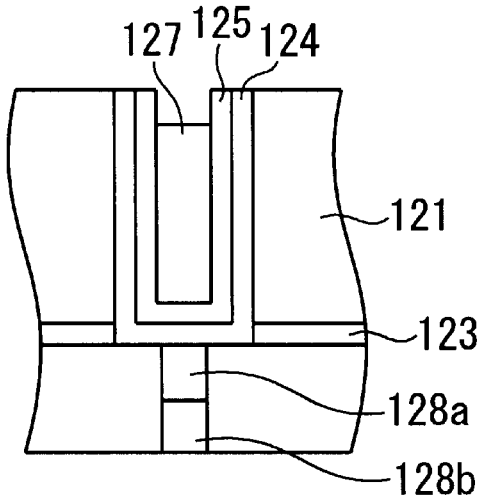
Figure 12C:
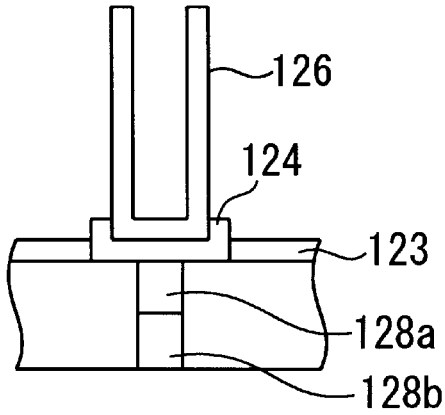

FIGS. 12A through 12C show a method of forming the so-called capacitance for storing electric charges. In this method, as shown in FIG. 12A, a hole 122 is bored in an insulating film 121 by a method such as dry etching. Thereafter, a barrier metal 124 containing at least one of Ta, a Ta compound, Ti and a Ti compound is formed as a film in the hole 122, followed by forming a ruthenium film 125 by a CVD method or the like and burying a burying material 127 therein. The barrier metal 124 is electrically connected to the substrate through a plug made of films 128*a*, 128*b*. The films 128*a*, 128*b* should preferably be so arranged that the film 128*a* contains at least one of Ta, a Ta compound, Ti and a Ti compound, and the film 128*b* is made of polysilicon or the like.

Next, as shown in FIG. 12B, the semiconductor device having the structure of FIG. 12A is subjected to a CMP treatment in the CMP unit 1. This permits the ruthenium film 125 and the barrier metal 124 to be polished, thereby leaving the ruthenium film 125 and the barrier metal 124 that are buried inside the hole 122. Thereafter, the insulating film 121 is removed by wet treatment or a dry etching method, thereby forming a lower electrode 126 made of the ruthenium film 125 and serving as a capacitance. A nitride film 123 is provided as a stopper film for the lower layer at the time when the insulating film 121 is removed.

Figure 13A:
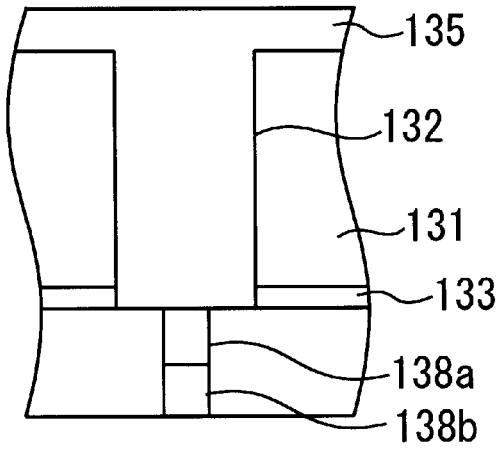
FIGS. 13A through 13C show a method of forming the so-called capacitance for storing electric charges.
Figure 13B:
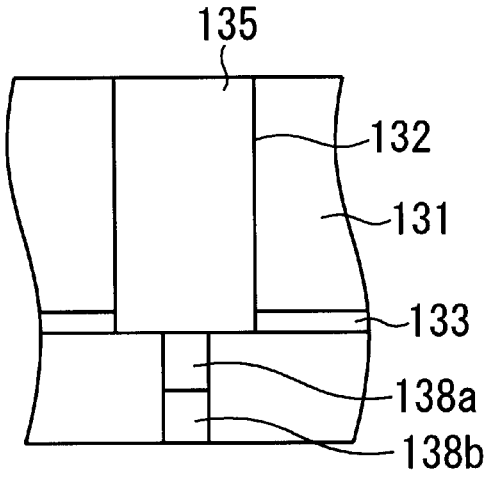
Figure 13C:
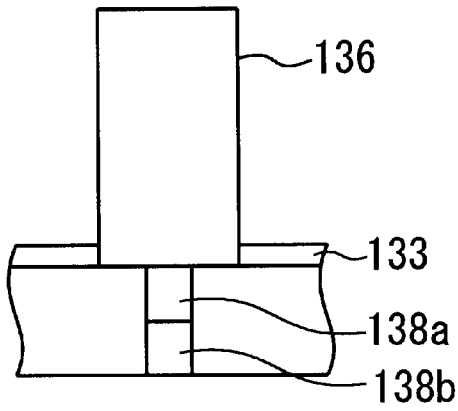

FIGS. 13A through 13C show a method of forming the so-called capacitance for storing electric charges. As shown in FIG. 13A, according to this method, a hole 132 is bored in an insulating film 131 by a method such as dry etching, followed by forming a ruthenium film 135 over the entire surfaces within the hole 132 by a CVD method or the like. The ruthenium film 135 is electrically connected to the substrate or the like via a plug made of films 138*a*, 138*b*. The films 138*a*, 138*b* should preferably be so arranged that the film 138*a* contains at least one of Ta, a Ta compound, Ti and a Ti compound, and the film 138*b* is made of polysilicon or the like.

Next, as shown in FIG. 13B, the semiconductor device having the structure of FIG. 13A is subjected to a CMP treatment in the CMP unit 1. This permits the ruthenium film 135 to be polished, thereby leaving the ruthenium film 135 that is buried inside the hole 132. Thereafter, the insulating film 131 is removed by wet treatment or a dry etching method, thereby forming a lower electrode 136 serving as a capacitance. A nitride film 133 is used as a stopper film for the lower layer at the time when the insulating film 131 is removed.

Upon CMP treatment carried out in FIGS. 3A and 3B, 4A and 4B, 10A and 10B, 11A and 11B, 12A through 12C and 13A through 13C, the characteristics of the polishing slurry are inspected by means of the measuring instrument 18 in the polishing slurry feeding system of FIG. 1. In the polishing slurry vessel 21 of the measuring instrument 18, an electromotive force occurring between different types of metals is generated between the electrode (A) 24 and the electrode (B) 25 through the polishing slurry 22. The thus generated electric current is detected by means of the ampere meter 26 and monitored with the personal computer 27. At this time, such an ionization reaction as shown in Table 1 takes place in the polishing slurry 22 in the vicinity of the electrode (A) 24 or the electrode (B) 25.

TABLE 1

| Ionization reaction |
|---|
| (1) $Cu \rightarrow Cu^{2+} + 2e^-$ |
| (2) $Ta \rightarrow Ta^{5+} + 5e^-$ |
| (3) $W \rightarrow W^{6+} + 6e^-$ |
| (4) $Ti \rightarrow Ti^{4+} + 4e^-$ |
| (5) $Ru \rightarrow Ru^{4+} + 4e^-$ |

For instance, where the electrode (A) 24 is made of copper (Cu), a divalent Cu cation and two electrons generate. When the electrode (B) 25 is made of tantalum (Ta), a pentavalent Ta cation and five electrons generate. The chemical reaction quantity varies depending on the characteristics of the polishing slurry, so that the resulting value of the variation is converted to a current value. This current value is detected by means of the ampere meter 26 and monitored according to the personal computer 27, thereby monitoring the variation of the components in the polishing slurry. The components of the polishing slurry are controlled depending on the results of the monitoring, thus enabling one to carry out stable CMP treatment.

In Table 2, there are shown combinations of the electrode (A) 24 and the electrode (B) 25 used for the measurement of electromotive force. It will be noted that during the CMP treatment in the CMP unit 1, a film to be polished and a polishing slurry undergo chemical reaction, thereby causing such a chemical reaction as shown in Table 1 to occur. Accordingly, in order to more accurately detect the characteristics of a polishing slurry, it is favorable to use the same material for the electrode (A) 24 or the electrode (B) 25 as a material for the film to be polished. This permits the chemical reaction quantity in the course of an actual CMP treatment to be detected within the measuring instrument 18. This ensures reliable detection of the characteristics of a polishing slurry relative to the film to be polished.

For instance, as shown in FIGS. 3A, 3B and 4A, 4B, for the CMP treatment of the copper films 34, 47, the copper films 34, 47 and the films formed as the barrier metals 33, 46 containing at least one of Ta or a Ta compound, Ti and a Ti compound are polished. For the CMP treatment of a tungsten film, a film containing at least one of Ta or a Ta compound, Ti and a Ti compound is formed as a barrier metal, so that the tungsten film and the film containing at least one of Ta or a Ta compound, Ti and a Ti compound have to be polished. Accordingly, as shown in Table 2, it is preferred for the CMP treatment of a copper film that copper (Cu) is used as a material for the electrode (A) 24 and Ta, TaN, Ti, TiN, a Ta compound, a Ti compound or the like is used as a material for the electrode (B) 25. Moreover, as shown in FIGS. 10A and 10B, 11A and 11B, it is preferred for the CMP treatment of a tungsten film to use tungsten (W) as a material for the electrode (A) 24 and Ta, TaN, Ti, TiN, a Ta compound, a Ti compound or the like as a material for the electrode (B) 25. In addition, as shown in FIGS. 12A through 12C and FIGS. 13A through 13C, it is preferred for the CMP treatment of a ruthenium film to use ruthenium (Ru) as a material for the electrode (A) 24 and Ta, TaN, Ti, TiN, a Ta compound, a Ti compound or the like as a material for the electrode (B) 25. Thus, it is preferred that the materials for the electrode (A) 24 and the electrode (B) 25 should contain at least one of metals for a material subjected to the CMP treatment.

TABLE 2

Electrodes for measuring an electromotive force

| | | Electrode (B) | | | | | |
|---|---|---|---|---|---|---|---|
| | | Ta | TaN | Ti | TiN | Ta compound | Ti compound |
| Electrode (A) | Cu | ○ | ○ | ○ | ○ | ○ | ○ |
| | W | ○ | ○ | ○ | ○ | ○ | ○ |
| | Ru | ○ | ○ | ○ | ○ | ○ | ○ |

It will be noted that metal ions diffuse from the electrode (A) 24 and the electrode (B) 25 into the polishing slurry 22 through the ionization reaction and that if the material of a film to be polished is of the same type as those materials of the electrode (A) 24 and the electrode (B) 25, the material of a wiring can be suppressed from being contaminated with such metals or the like.

When the variation of an electric current is detected with the ampere meter 26 of the measuring instrument 18, the personal computer 27 sends out a warning. In order to return of the components in the polishing slurry to normal values, instructions are given to the pure water vessel 9, the particle slurry vessel 10 or the $H_2O_2$ vessel 11 to adjust the components in the polishing slurry 22 within preset ranges. More particularly, the component of a stock fluid in the pure water vessel 9, the particle slurry vessel 10 or the $H_2O_2$ vessel 11 is adjusted, or the ratios of the stock fluids being fed to the mixing vessel are changed by use of the valves 12, 13, 14 and their respective flow meters 15, 16 and 17.

As stated hereinabove, according to the first embodiment, the measuring instrument 18 is set in the polishing slurry feeding system, and an electromotive force, which occurs between different types of metals, i.e. between the electrode (A) 24 and the electrode (B) 25 immersed in the polishing slurry 22 in the polishing slurry vessel 21, is generated so that an electric current passing between the electrode (A) 24 and the electrode (B) 25 is monitored. Where a chemical reaction quantity is varied depending on the characteristics of the polishing slurry, one is enabled to detect the varied value after conversion to a current value. Where the current value is varied, the components in the polishing slurry can be adjusted to return to normal values.

In this way, the characteristics of the polishing slurry can be readily controlled, and thus the occurrence of scratches, dishing, erosion, defects and the like can be suppressed by the control of process characteristics in the CMP treatment. Accordingly, the yield in the manufacture of electronic devices can be improved. In short, when using the system according to the first embodiment, highly reliable semiconductor devices can be manufactured while suppressing the occurrence of scratches, dishing, erosion, defects and the like.

Second Embodiment

Figure 5:
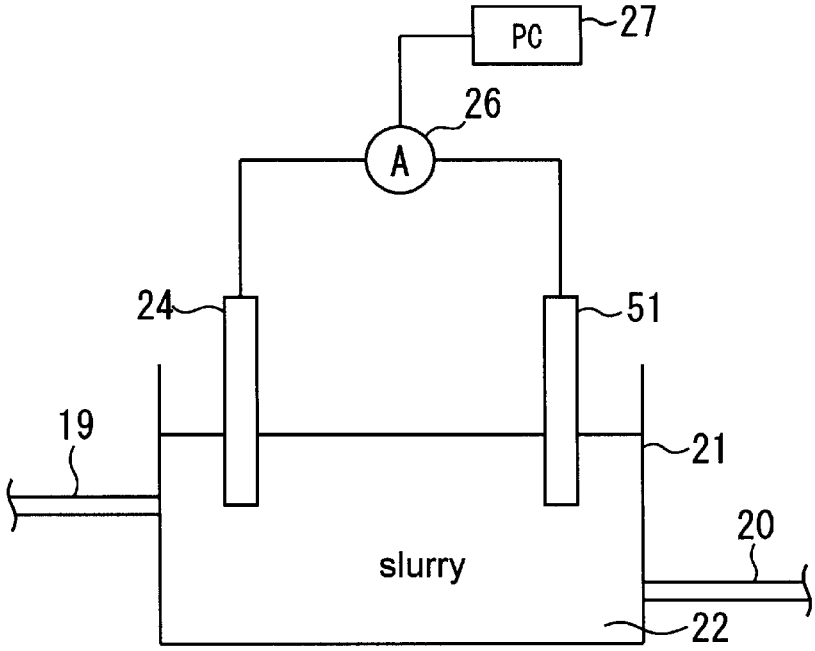
FIG. 5 is a schematic view showing a measuring instrument of a polishing slurry feeding system according to a second embodiment of the invention.

FIG. 5 is a schematic view showing a measuring instrument 18 of a polishing slurry feeding system according to a second embodiment of the invention. In the second embodiment, the electrode (B) 25 of the measuring instrument 18 of the first embodiment is replaced by a standard electrode (reference electrode) 51. The electrode (A) 24 serves as a working electrode and is constituted of a metal of the same type as a material to be measured. Where copper, tungsten or ruthenium is polished, it is preferred to use any one of metals indicated in Table 2 as a material for the electrode (A) 24. The standard electrode 51 provides a reference potential for the working electrode 24. Eventually, it becomes unnecessary to use two types of metals of the films to be polished as materials for two electrodes, respectively, but only one type of metal selected from the metals of the films to be polished can be used for a material of the electrode (A) 24 to detect a change in current value from a certain standard value by means of the ampere meter 26.

As stated hereinabove, according to the second embodiment, if a material which is unlikely to undergo chemical reaction is contained in metals to be polished, only a material that is likely to undergo chemical reaction can be used as a material for the electrode (A) 24. Thus, an electric current passing between the electrode (A) 24 and the standard electrode 51 can be reliably detected. For this purpose, it is more preferred to use a material that is most likely to undergo the reaction among the metals of films to be polished for use as the electrode (A) 24. This permits a current value to be detected more accurately.

Third Embodiment

Figure 6:
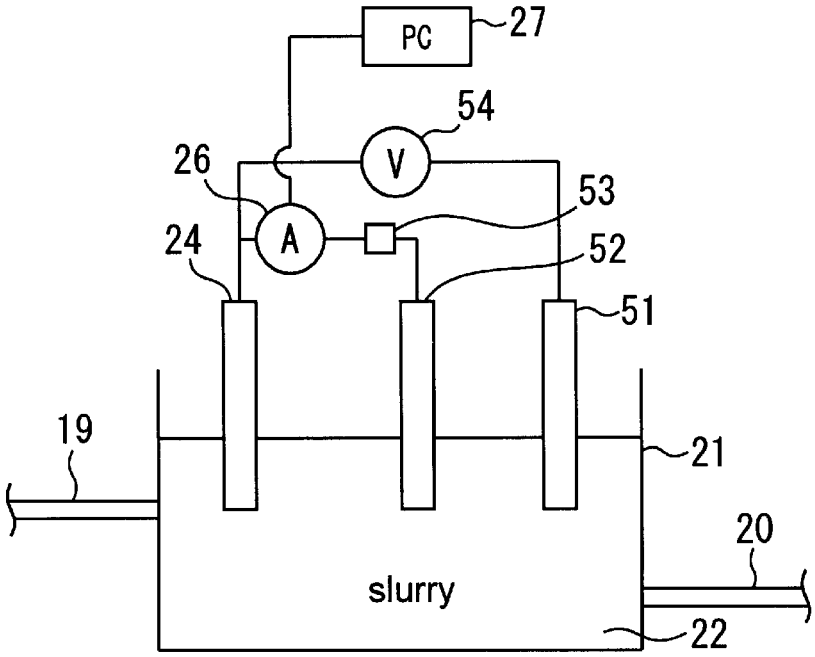
FIG. 6 is a schematic view showing the measuring instrument of a polishing slurry feeding system according to a third embodiment of the invention.

FIG. 6 is a schematic view showing the measuring instrument 18 of a polishing slurry feeding system according to a third embodiment of the invention. The third embodiment differs from the first embodiment in only the arrangement of the measuring instrument 18. The measuring instrument 18 shown in FIG. 6 is provided with the electrode (A) 24, a counter electrode 52 and a standard electrode 51. An ampere meter 26 and a variable power supply 53 are provided between the electrode (A) 24 and the counter electrode 52. A voltmeter 54 is provided between the electrode (A) 24 and the standard electrode 51. Platinum (Pt) is used, for example, as a material for the counter electrode 52.

The potential between the electrode (A) 24 and the counter electrode 52 is varied therebetween by use of the variable power supply 53 so as to pass an electric current between the electrode (A) 24 and the counter electrode 52. Where the electrode (A) 24 undergoes ionization reaction in the polishing slurry 22, the chemical reacting quantity varies depending on the characteristics of the polishing slurry. The chemical reaction quantity between the polishing slurry 22 and the electrode (A) 24 can be determined by measuring the variation of the electric current by means of the ampere meter 26. More particularly, in the third embodiment, electric charges are positively given from outside to cause the chemical reaction, so that the chemical reaction can be more sensitively detected, thereby ensuring more accurate measurement of the characteristic variation of the polishing slurry.

The electrode (A) 24 functions as a working electrode and is constituted of a metal which is of the same type of metal to be measured. Where copper, tungsten or ruthenium is polished, any metal indicated in Table 2 is conveniently used as a material for the electrode (A) 24. The standard electrode 51 is one which serves for a reference of potential of the working electrode and the potential of the electrode (A) 24 is measured with a voltmeter 54. The counter electrode 52 is connected to the electrode (A) 24 used as a working electrode and is one that is connected in series with the working electrode in which an electric current passes without any trouble when the working electrode is set at a given potential by use of the variable power supply 53. Thus, the measuring instrument 18 of the third embodiment is arranged to constitute a constant potential electrolytic device which is able to suppress the potential variation of the electrode (A) 24 and invariably keeps the potential of the electrode (A) 24 relative to the standard electrode 51 at an intended level. This arrangement permits the electrode (A) 24 to be set at a constant potential by the action of the standard electrode 51 in the case where reaction species are reduced in concentration in the vicinity of the surface of the electrode (A) 24 as the chemical reaction proceeds at the electrode (A) 24, thereby ensuring stable measurement.

As stated hereinabove, according to the third embodiment, an electric current is passed between the electrode (A) 24 and the counter electrode 52 by use of the variable power supply 53 so that a current variation is measured by means of the ampere meter 26 to measure the chemical reaction quantity between the polishing slurry and the electrode (A) 24. Thus, the chemical reaction can be detected more sensitively, thereby measuring the characteristics of the polishing slurry with higher accuracy. This allows the characteristics of the polishing slurry to be readily controlled, and the yield in the manufacture of a semiconductor device can be improved by controlling process characteristics in the CMP treatment.

Fourth Embodiment

Figure 7:
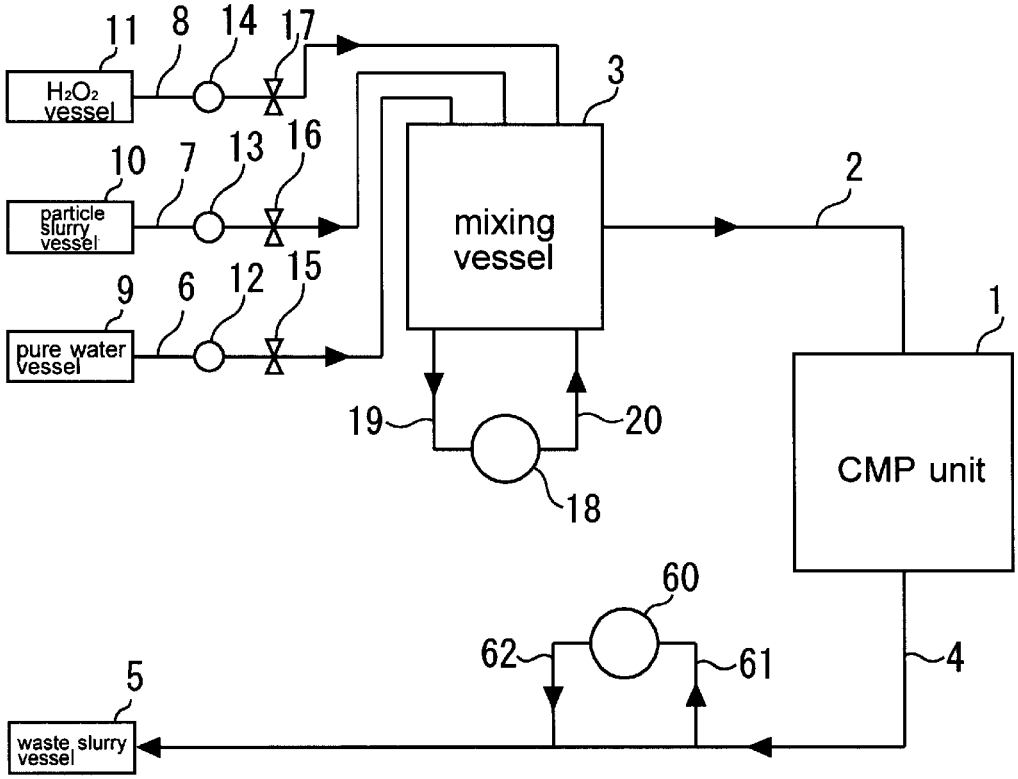
FIG. 7 is a schematic view showing a polishing slurry feeding system according to a fourth embodiment.

FIG. 7 is a schematic view showing a polishing slurry feeding system according to a fourth embodiment. In the fourth embodiment, a measuring instrument 60 is provided at a waste slurry side downstream of the CMP unit 1. The waste slurry after the CMP treatment is collected in a waste slurry vessel 5 from the CMP unit 1 through a waste slurry pipe 4 and discharged. The measuring instrument 60 is connected to the waste slurry pipe 4 via pipes 60, 61, and the waste slurry sent from the waste slurry pipe 4 to the measuring instrument 60 through the pipe 61 is inspected in the measuring instrument 60, followed by passing to the waste slurry pipe 4 through the pipe 62 and collecting in the waste slurry vessel 5.

The measuring instrument 60 provided at the waste slurry side is arranged similarly to the measuring instrument 18 shown in FIGS. 2, 5 and 6, in which the variation of a current passing between two electrodes is measured, like the first to third embodiments. In this manner, the chemical reaction quantity in the course of an actual CMP treatment can be detected in the measuring instrument 60 by detecting the current value between the electrodes at the waste slurry side, thereby ensuring reliable detection of characteristics of a polishing slurry to a film to be polished.

It will be noted that although the characteristics of the polishing slurry can be detected by providing the measuring instrument 60 only on the waste slurry side, it is preferred to provide measuring instruments 18, 60 on a polishing slurry feeding side and on the waste slurry side, respectively, as is particularly shown in FIG. 7. The measurement obtained from the measuring instrument 18 prior to the CMP treatment is compared with the measurement from the measuring instrument 60, a difference between both measurements is invariably kept constant by monitoring by means of the personal computer. This entails that the chemical reaction quantity prior to the CMP treatment and the chemical reaction quantity after the CMP treatment can be made uniform, thereby suppressing the characteristic variation of the polishing slurry. Where the difference between the measurements has varied, the components in the polishing slurry are properly adjusted, like the first embodiment, so that stable CMP treatment can be carried out.

As stated hereinabove, according to the fourth embodiment, the characteristics of a polishing slurry can be readily controlled by monitoring such that a difference between the measurement from the measuring instrument 18 and the measurement from the measuring instrument 60 is invariably kept constant. Accordingly, the yield in the manufacture of a semiconductor device can be improved by controlling process characteristics in the CMP treatment.

Fifth Embodiment

Figure 8:
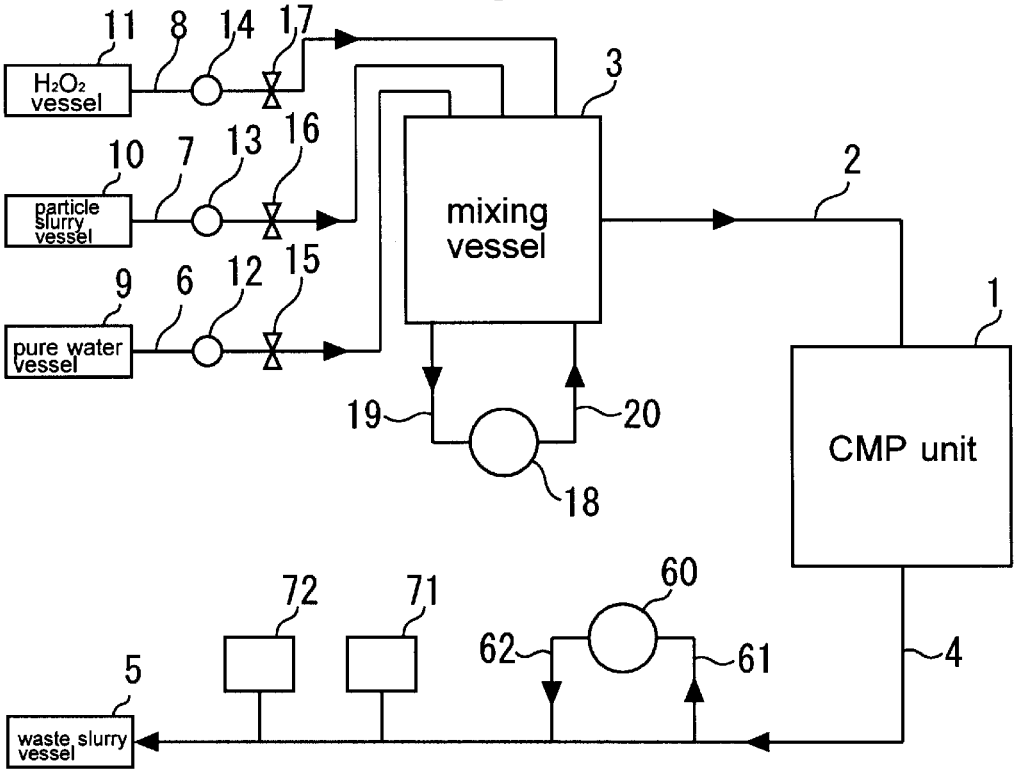
FIG. 8 is a schematic view showing a polishing slurry feeding system according to a fifth embodiment.

FIG. 8 is a schematic view showing a polishing slurry feeding system according to a fifth embodiment. In the fifth embodiment, a pH measuring instrument 71 and a pH adjuster 72 are, respectively, provided at a waste slurry side downstream of the CMP unit 1 in addition to the arrangement of the fourth embodiment. The waste slurry from the CMP unit 1 contains various types of elements, and it is difficult to judge whichever the waste slurry is acidic, neutral or alkaline at the time when it is discharged from the CMP unit 1. Under these circumstances, due care should be paid to the collection and handling of the waste slurry.

In the fifth embodiment, the pH of a waste slurry is measured by means of the pH measuring instrument 71 provided in the course of the waste slurry pipe 4. The waste slurry is controlled to show neutrality by use of the pH adjuster 72 set in the course of the waste slurry pipe 4. Thus, the pH of the waste slurry is adjusted to, so that the waste slurry can be neutral (pH=7). It will be noted that the pH measuring instrument 71 may be a $H_2O_2$ densitometer.

According to the fifth embodiment, the pH of the waste slurry can be controlled at an appropriate value, so that process characteristics in the CMP treatment can be controlled and the adverse influence of the waste slurry on surroundings can be avoided.

Sixth Embodiment

Figure 9:
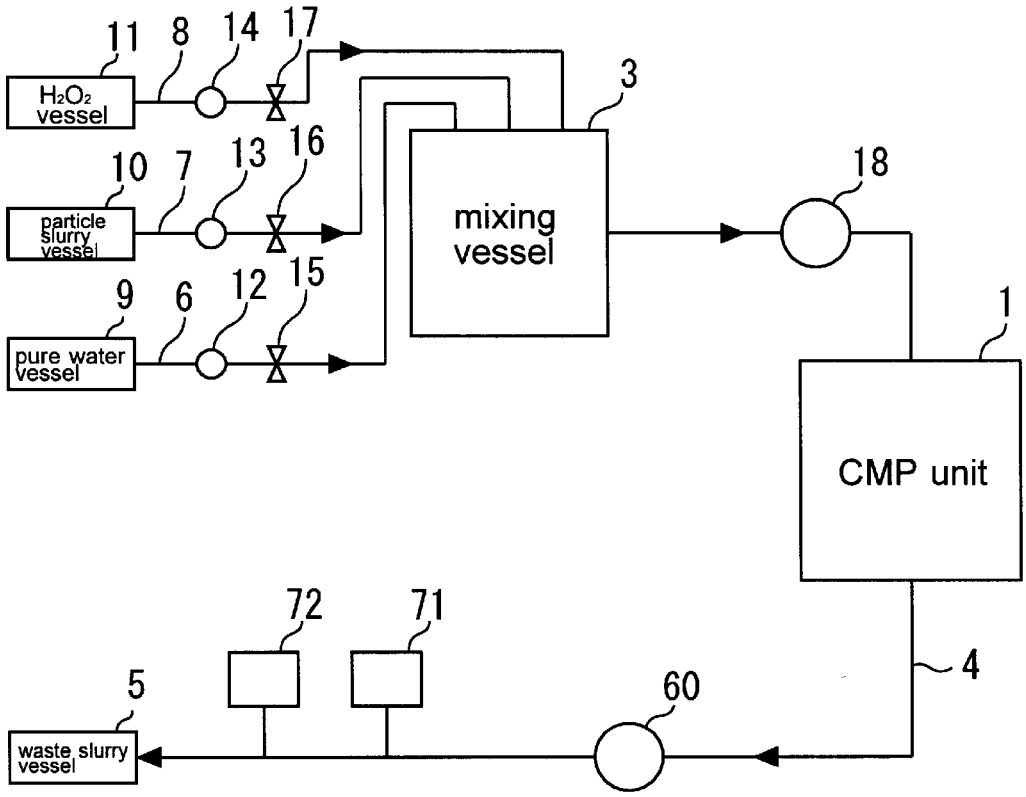
FIG. 9 is a schematic view showing a polishing slurry feeding system according to a sixth embodiment.

FIG. 9 is a schematic view showing a polishing slurry feeding system according to a sixth embodiment. As shown in FIG. 9, in the sixth embodiment, such measuring instruments 18, 60 as stated hereinabove are, respectively, connected in series with the mixing vessel 3 and the CMP unit 1. In this way, the measuring instruments 18, 60 may be provided directly to the feed pipe 2 and the waste slurry pipe 4. According to the sixth embodiment, similar effects as in the foregoing embodiments can be obtained, and pipes 19, 20, 61, 62 are unnecessary, with the system being arranged simply.

It will be noted that although the variation in polishing characteristics is detected from a variation in value of a current passing between two electrodes in the embodiments set out hereinbefore, similar results may also be obtained when the variation of polishing characteristics is detected from a variation in difference of a potential between two electrodes.

The invention is so arranged as having set forth hereinbefore and has the following effects.

When a variation in value of a current passing between the electrodes immersed in a polishing slurry or a variation in difference of a potential between the electrodes is detected, the variation in chemical reaction quantity of the electrodes and the polishing slurry can be detected, enabling the characteristics of the polishing slurry to be detected.

When the material for individual electrodes should contain at least one of materials for a film to be polished, the chemical reaction quantity in an actual CMP treatment can be detected, ensuring reliable detection of the characteristics of a polishing slurry to the film to be polished.

When the electrode is so arranged that it contains at least one of copper, tungsten, ruthenium, tantalum, tantalum nitride, a tantalum compound, titanium, titanium nitride and a titanium compound, the characteristics of a polishing slurry, which is used to polish a copper film or a tungsten film used as a wiring, a tungsten film used as a plug electrically connecting an upper wiring and a lower wiring therewith, a ruthenium film used as an electrode of a capacitance, or tantalum or a tantalum compound, or titanium or a titanium compound used as a barrier metal, can be reliably detected.

A power supply causing a potential difference between electrodes, and a reference electrode immersed in a polishing slurry and serving as a standard of the potential difference are provided, so that if the concentration of reaction species in the vicinity of the electrode surface is reduced, the electrodes can be set at a given potential by means of the power supply and the reference electrode, ensuring stable measurement.

The characteristics of a polishing slurry are measured on charge and discharge sides of the polishing slurry to detect a difference between the resultant measurements, so that the characteristics of the polishing slurry can be detected more accurately.

Since a component adjusting means for adjusting the components in the polishing slurry depending on the detected characteristics of the polishing slurry is provided, the characteristic variation can be fed back, so that stable polishing can be carried out continuedly.

Since a pH detection means for detecting pH of the polishing slurry and a pH adjusting means for adjusting a pH of the polishing slurry, the pH of a waste slurry can be detected and adjusted.

The pH of the polishing slurry can be adjusted within a pH of 7±1 by means of the pH adjusting means, the waste slurry can be adjusted to neutrality, thereby avoiding an adverse influence on surroundings.

Since the variation in characteristics of the polishing slurry can be suppressed, scratches, dishing, erosion, defects and the like are suppressed from occurring, ensuring the manufacture of a semiconductor device of high reliability.

Obviously many modifications and variations of the present invention are possible in the light of the above teachings. It is therefore to be understood that within the scope of the appended claims the invention may by practiced otherwise than as specifically described.

The entire disclosure of a Japanese Patent Application No. 2002-159641, filed on May 31, 2002 including specification, claims, drawings and summary, on which the Convention priority of the present application is based, are incorporated herein by reference in its entirety.

What is claimed is:

1. A system for manufacturing a semiconductor device by polishing a substrate surface comprising:

a polishing pad for polishing said substrate;

a polishing slurry feeding apparatus for feeding a polishing slurry to said substrate surface; and a measuring apparatus immersed in said polishing slurry and including at least two electrodes;

wherein said measuring apparatus is arranged so that a characteristic variation of said polishing slurry is detected from a value of a current passing between said electrodes or a variation in potential difference between said electrodes, wherein materials for said electrodes include at least one material for a film to be polished on said substrate surface.

2. A system for manufacturing a semiconductor device according to claim 1, wherein the material for said electrodes contain at least one material selected from copper, tungsten, ruthenium, tantalum, tantalum nitride, a tantalum compound, titanium, titanium nitride and a titanium compound.

3. A system for manufacturing a semiconductor device according to claim 1, further comprising a power supply for creating a potential difference across said electrodes and a reference electrode immersed in said polishing slurry and serving to provide a reference for said potential difference.

4. A system for manufacturing a semiconductor device according to claim 1, wherein said measuring apparatus is provided on a feeding side of said polishing slurry to said substrate surface and also on a waste slurry side of said polishing slurring after having fed to said substrate surface, respectively, and said characteristic variation of said polishing slurry is detected from a variation in difference between measurements determined by both said measuring apparatus.

5. A system for manufacturing a semiconductor device according to claim 1, further comprising a component-adjusting apparatus for adjusting components in said polishing slurry, said component-adjusting apparatus acting to adjust components in said polishing slurry in accordance with said characteristic variation of said polishing slurry detected by said measuring apparatus.

6. A system for manufacturing a semiconductor device according to claim 1, further comprising a pH detecting apparatus for detecting a pH of said polishing slurry after having fed to said substrate surface, and a pH-adjusting apparatus for adjusting a pH of said polishing slurry after having fed to said substrate surface.

7. A system for manufacturing a semiconductor device according to claim 6, wherein said pH-adjusting apparatus is able to adjust the pH of said polishing slurry, after having fed to said substrate surface, within a pH of 7±1.

8. A polishing slurry feeder for feeding a polishing slurry to a substrate polishing device, comprising:

a measuring apparatus immersed in said polishing slurry and including at least two electrodes;

wherein said measuring apparatus is arranged so that a characteristic variation of said polishing slurry is detected from a value of a current passing between said electrodes or a variation in potential difference between said electrodes, wherein a material for said electrodes includes at least one of materials for a film to be polished on said substrate surface.

9. An polishing slurry feeder according to claim 8, wherein the material for said electrodes contains at least one material selected from copper, tungsten, ruthenium, tantalum, tantalum nitride, a tantalum compound, titanium, titanium nitride and a titanium compound.

10. A polishing slurry feeder according to claim 8, further comprising a power supply for creating a potential difference across said electrodes and a reference electrode immersed in said polishing slurry and serving to provide a reference for said potential difference.

11. A polishing slurry feeder according to claim 8, further comprising a component-adjusting apparatus for adjusting components in said polishing slurry, said component-adjusting apparatus acting to adjust components in said polishing slurry in accordance with said characteristic variation of said polishing slurry detected by said measuring apparatus.

12. A method for manufacturing a semiconductor device using a semiconductor manufacturing system, said method comprising the steps of:

providing a polishing pad for polishing said substrate surface;

providing a polishing slurry feeding apparatus for feeding a polishing slurry to said substrate surface; and providing a measuring apparatus immersed in said polishing slurry and including at least two electrodes;

wherein said measuring apparatus is arranged so that a characteristic variation of said polishing slurry is detected from a value of a current passing between said electrodes or a variation in potential difference between said electrodes, wherein materials for said electrodes include at least one material for a film to be polished on said substrate surface.

* * * * *